US006684603B2

(12) United States Patent
Nervo

(10) Patent No.: US 6,684,603 B2
(45) Date of Patent: Feb. 3, 2004

(54) AUTOMATIC CAPPING EQUIPMENT, PROVIDED WITH A STERILIZING DEVICE

(75) Inventor: Giovanni Nervo, Fidenza (IT)

(73) Assignee: Procomac S.p.A., Sala Baganza (IL)

( * ) Notice: Subject to any disclaimer, the term of this patent is extended or adjusted under 35 U.S.C. 154(b) by 0 days.

(21) Appl. No.: 10/155,152

(22) Filed: May 24, 2002

(65) Prior Publication Data

US 2002/0178689 A1 Dec. 5, 2002

(30) Foreign Application Priority Data

May 30, 2001 (EP) ..... 01830347

(51) Int. Cl.[7] ..... B65B 7/28
(52) U.S. Cl. ..... 53/167; 53/331.5
(58) Field of Search ..... 53/167, 317, 331.5

(56) References Cited

U.S. PATENT DOCUMENTS 3,350,839 A 11/1967 Carter ..... 53/88
4,742,667 A * 5/1988 Muller et al. ..... 53/167

FOREIGN PATENT DOCUMENTS

DK 29505567 4/1996 ..... B67B/3/20

* cited by examiner

*Primary Examiner*—John Sipos
(74) *Attorney, Agent, or Firm*—Darby & Darby

(57) ABSTRACT

An automatic capping equipment comprises at least a rotary screwing head (10) able to screw a cap (19) onto the mouth of a container (9) fed below said screwing head (10). The screwing head (10) operates in a sterile area (23) of the equipment (1) and is supported by a related sliding support shaft (12) destined to be animated with an alternating motion, whereto are associated heating means. the heating means (25) are positioned in correspondence with an operating part (12*a*) of each support shaft (12) proximate to said sterile area (23) and are able to perform a heating action that is localised to said operating part (12*a*) of the shaft (12) to maintain it at such a temperature as to guarantee its sterile condition and in such a way that the remaining part of each shaft (12) is not substantially heated by the heating means (25).

10 Claims, 4 Drawing Sheets

Figure 1:
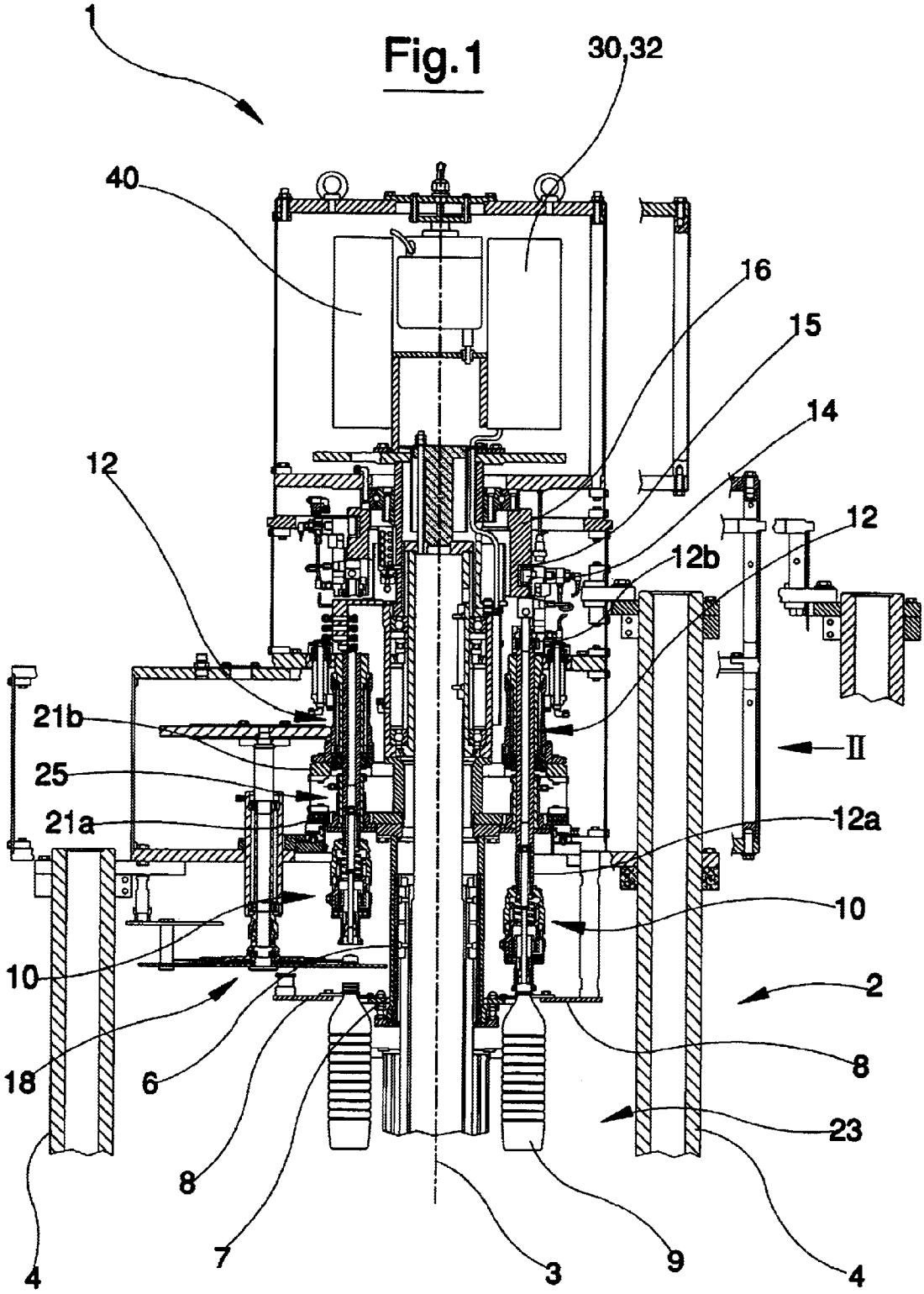

1
30,32
40
16
15
14
12
12
12b
21b
25
21a
II
12a
10
10
2
18
6
8
8
23
7
3
9
4
4

AUTOMATIC CAPPING EQUIPMENT, PROVIDED WITH A STERILIZING DEVICE

BACKGROUND OF THE INVENTION AND PRIOR ART

The present invention relates in general to automatic capping equipment.

Automatic capping equipment are machines that allow tightly to close threaded caps or stoppers on the mouth of containers to be packaged, for instance of the kind destined to contain food substances such as drinks. Although capping equipment are known which allow to close a single container at a time, capping machines are widely used which accomplish the operation of closing multiple caps on respective containers that travel along a circular trajectory, which capping machines are known as carrousel machines. More specifically, the invention relates to an automatic capping equipment provided with sterilisation means, having at least a rotary screwing head able to screw a cap onto the mouth of a container fed below the screwing head, in which the screwing head operates in a sterile area of the equipment and is supported by a related sliding support shaft, destined to be animated by an alternating motion, heating means being associated to each support shaft.

When capping equipment needs to be employed for packaging food substances susceptible to being contaminated as a result of contact with the outside environment, such as fruit juice based drinks or vegetable preserves, particularly in the case of products that do not contain preserving additives, the operation of closing the containers housing the product to be packaged must be performed under sterile conditions.

In the past, this was achieved by heating the product to be packaged to such a temperature as to allow its pasteurisation in order to guarantee its sterility.

However, it is well known that heating food products above a determined temperature can cause an alteration thereof, which leads to a reduction of their quality and of their nutritional characteristics.

To overcome this drawback, use is preferred of "cold" packaging equipment in which the product to be packaged is only subjected to a fast heating, with a subsequent cooling, so as not to compromise its nutritional characteristics.

This is due to the fact that the containers with the product to be packaged are fed in an area in which a controlled atmosphere, pressurised with sterile air and previously sterilised with disinfectant substances such as peracetic acid 2% in solution, is present. The screwing head is immersed in this controlled atmosphere, which is usually located in a lower part of the capping equipment, so that it also remains under sterile conditions. However, the shaft that supports the screwing head, due to its alternating motion, can drag into the sterile area impurities coming from the upper part of the equipment (which is not immersed in the controlled atmosphere) in which are located the mechanical devices for the actuation of the screwing heads and the electrical and electronic control sets of the system. These impurities, penetrating into the sterile area where the containers are closed, could compromise the preservation of the sterility and integrity of the product to be packaged.

For this purpose, equipment has been devised that comprises a pressurised system able to supply steam at a temperature of about 120° C. in correspondence with the support shafts in order to maintain them under sterile conditions to prevent impurities coming from other areas of the machine and dragged by the alternating motion of the support shaft from penetrating into the sterile area where the containers are closed, contaminating it.

Capping equipment provided with this steam supplying system, which requires the presence of a steam generator and pipelines to transport the steam to the areas to be sterilised, have a rather complex structure, hence costly to produce. Moreover, the pressurised steam used for heating the support shaft, after exiting the pipelines, does not remain localised in correspondence with the parts of the support shaft that penetrate into the sterile area, but is dispersed towards other parts of the equipment. In particular, after the steam performs its heating action on the shafts, it penetrates in the areas where the mechanical actuation devices and the equipment control sets are present, heating them. Such heating causes thermal expansions of the mechanical organs of the equipment, which can lead to warping in said organs with the consequent reduction of the operational reliability of the equipment and the need to perform more frequent maintenance operations with additional operating costs.

PROBLEM TO BE SOLVED AND MEANS FOR SOLVING THE PROBLEM

The aim of the present invention is to eliminate the aforesaid drawbacks and this is achieved by the equipment of the present invention, which is characterised by the content of the claims set out below and in particular in that the heating means are associated to each support shaft in correspondence with an operating part thereof which is proximate to the sterile area and are able to perform a heating action that is localised to said operating part of the shaft to maintain it at such a temperature as to guarantee its sterile condition and in such a way that the remaining part of each shaft is not substantially heated by the heating means.

The present invention concentrating heat on the area to be protected, unlike the steam that heats the whole turret as in the prior art, allows the application on the turret itself of electronic systems for controlling the capping operation, which allow for instance the automatic ejection of any bottles capped incorrectly.

Thanks to these characteristics, an effective sterility is guaranteed for the equipment area in which the operation of tightly closing the caps onto the related containers takes place, in a simple and reliable manner, without undesired impacts on the operation of other elements of the equipment.

Advantageously, the heating means include at least a resistive organ able to be connected with a source of electrical energy.

Preferably, the equipment further comprises temperature sensor means, the heating means and the temperature sensor means being associated to control means able to regulate in feedback the supply of electrical energy to the resistive organs by said source, according to the temperature measured by the sensor means.

In this way, the temperature of the part of the shaft that supports the related screwing head and that comes in contact with the sterile area of the equipment, can be controlled in optimal fashion so as to remain within a predetermined range, sufficient to guarantee the sterility of this part of the shaft. Thanks to this control which allows to optimise the quantity of heat supplied to each shaft, there is no generation of excess heat which, in addition to constituting a waste and hence an undesired cost, could be transmitted to other parts of the equipment with harmful consequences.

MODES OF EXECUTION

Figure 2:
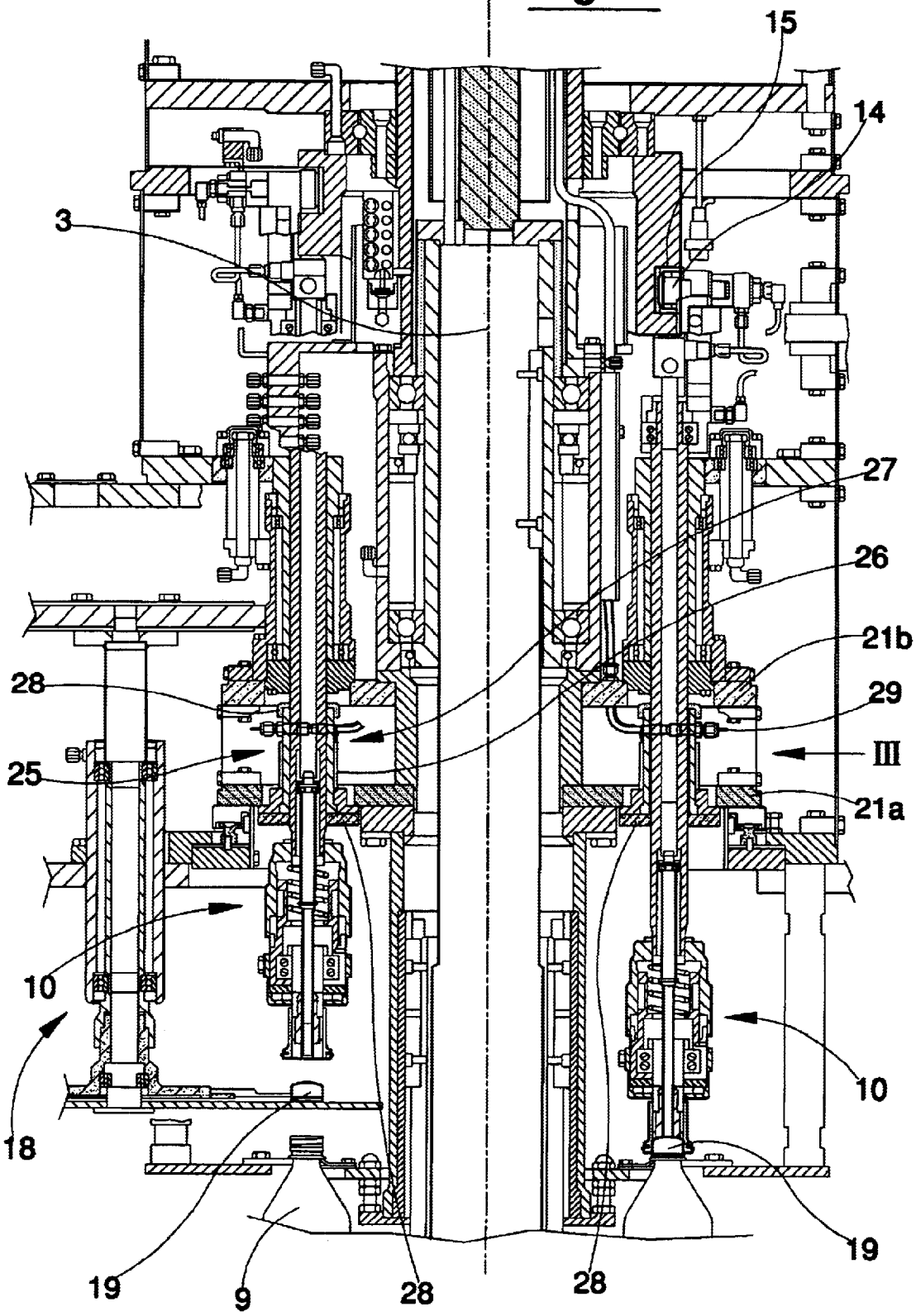
Figure 3:
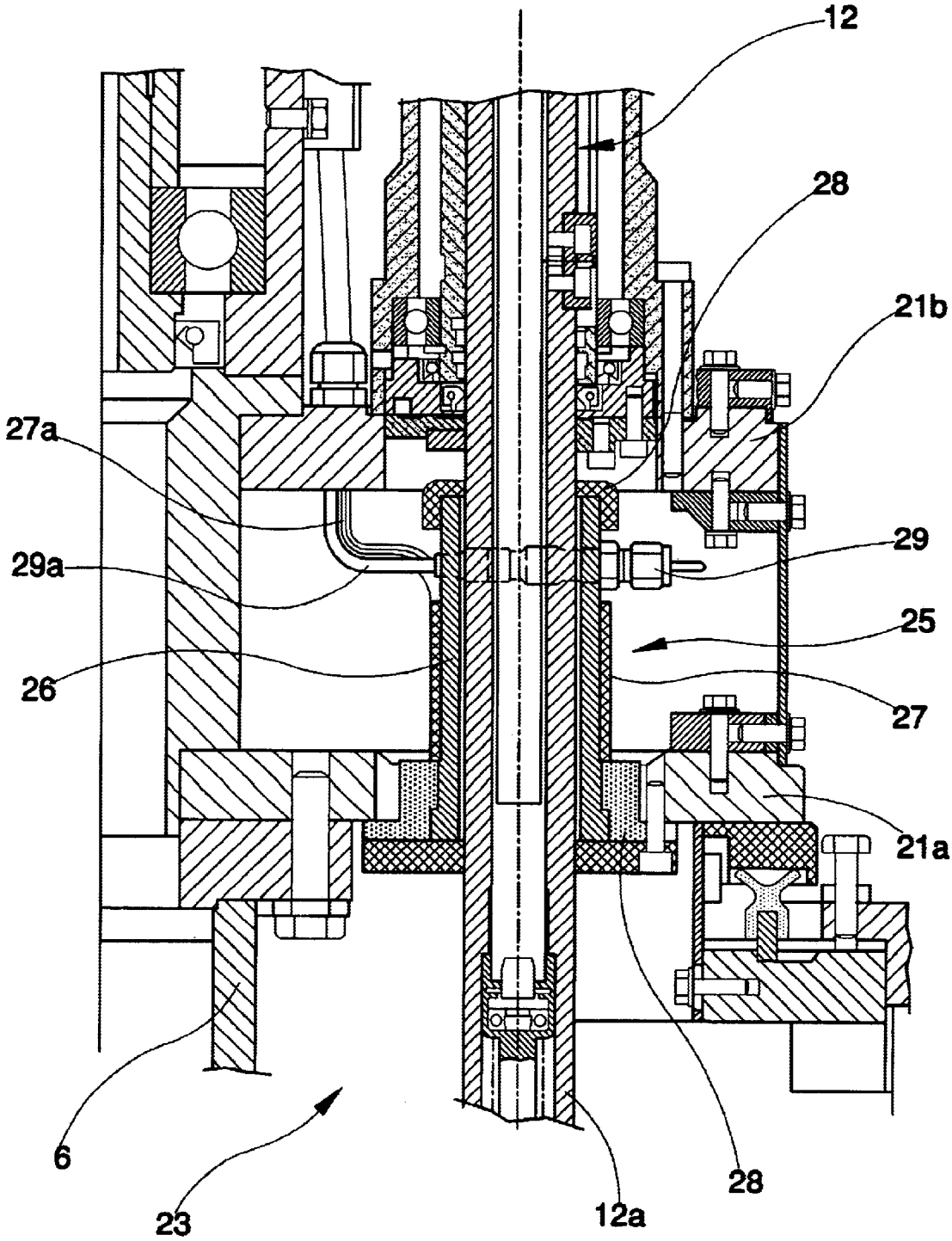
Figure 4:
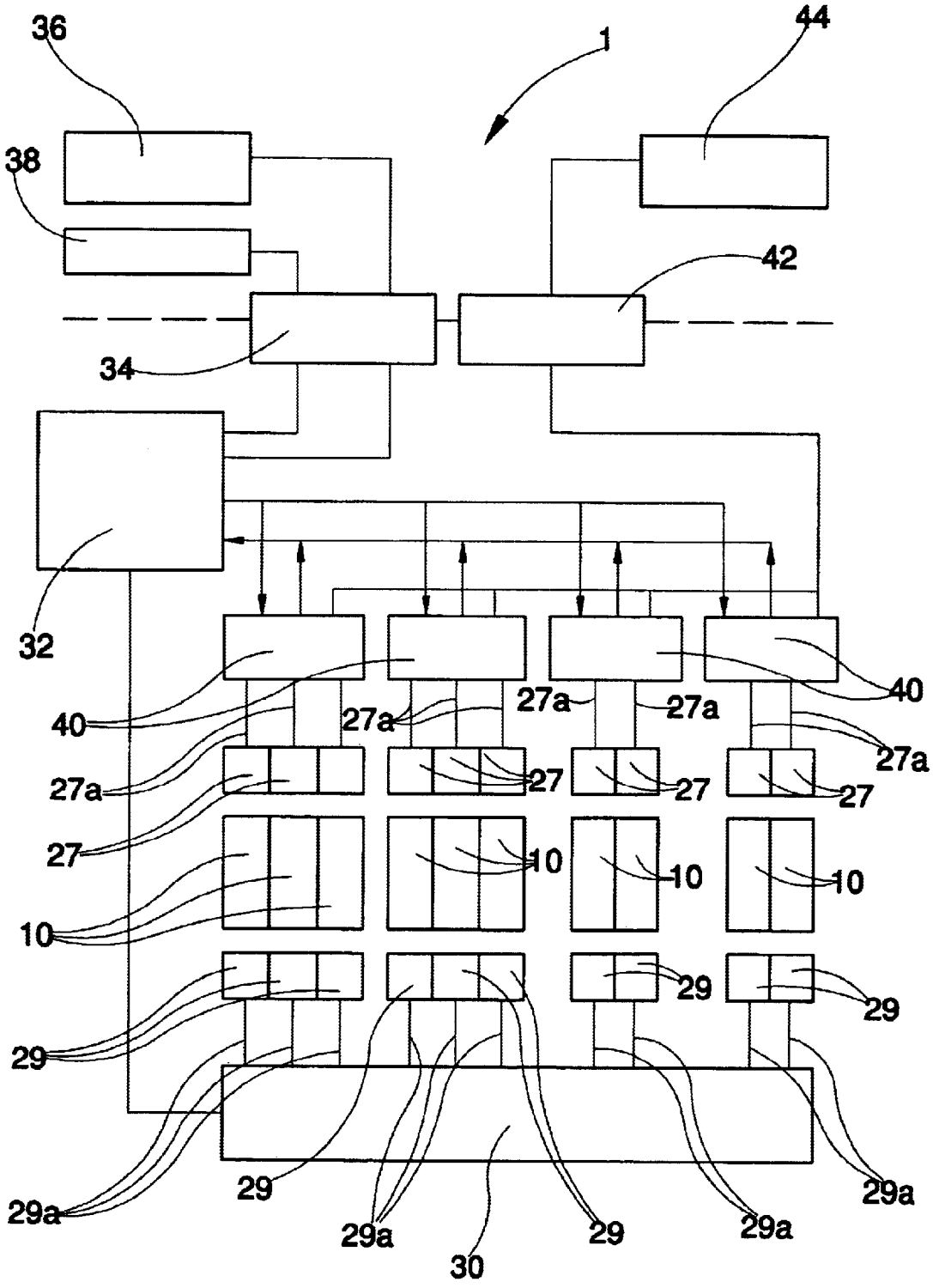

This and other characteristics shall become more readily apparent in the following description of a preferred embodiment illustrated, purely by way of non limiting example, in the accompanying drawing tables in which:

FIG. 1 is a sectioned front elevation view of an automatic capping equipment of the carrousel type, according to the invention, FIG. 2 is an enlarged view of a part indicated with arrow II in FIG. 1, FIG. 3 is an enlarged view of a detail indicated with arrow III in FIG. 2, and FIG. 4 is a block diagram illustrating in schematic form the main elements of a system for controlling the equipment according to the invention and their operative relationship.

With reference to FIGS. 1 through 3, the number 1 globally indicates a capping equipment according to the invention.

Although the accompanying figures and the description that follows consider a carrousel capping equipment, i.e. one that is able simultaneously to accommodate a plurality of containers set in motion on a circular trajectory of the machine to close them by means of caps subjecting the various containers to mutually staggered closing phases, the invention can be indifferently applied to a simpler capping equipment, able to close only a container at a time, individually fed thereto.

The equipment 1 comprises a stationary base structure 2 including pillars 4. Between the pillars 4 is present a tubular upright 6 so mounted as to be able to revolve about a cylindrical guide 7 whose axis 3 constitutes the main axis of the equipment 1. The upright 6 is set in rotation as a result of the operation of a motor set not shown herein as it is well known.

To the upright 6 are associated organs 8 for gripping and supporting a plurality of containers 9, for instance bottles, which are fed to the equipment 1 in usual fashion, typically by means of a conveyor belt and a worm screw feeder. The containers 9 can also be set to bear down onto a rotating platform not shown in the figures.

To the upright 6 is associated a plurality of screwing heads 10 (whereof only two are visible in FIG. 1) in such a way as to be able to rotate together with the upright 6 on a circular trajectory concentric with the axis 3.

Each screwing head 10 is supported by the lower operating part 12*a* of a support shaft 12, also called piston, able to translate in alternating fashion as a result of the rotation of the upright 6. For this purpose the upper part 12*b* of each shaft 12, opposite to the related screwing head 10, is provided with a roller 14 able to rotate about an axis perpendicular to that of the related shaft 12. The roller 14 engages a cam track 15 formed on a cylindrical stationary body 16 according to a plane that is inclined relative to the axis 3 in such a way as to exhibit a descending part and an ascending part relative to a horizontal plane perpendicular to the axis 3.

Each shaft 12, and hence the related screwing head 10 which is integral in rotation therewith, is also able to rotate about its own axis in such a way that the related screwing head 10 is also animated with rotary motion. Normally, the rotating motion of each shaft 12 is derived from the rotating motion of the upright 6 relative to the base structure 2 by means of known gear wheel transmission organs.

To the base structure 2 is also associated a device 18 for feeding caps 19 between each screwing head 10 and the related container 9. As a result of the downward motion of each of the screwing heads 10, i.e. towards the related container 9, and of the rotation of the screwing head 10 about its own axis, the caps 19 fed by the device 18 are screwed onto the mouth of the containers 19.

To allow each shaft 12 to move in alternating fashion and simultaneously to rotate about its own axis, to the upright 6 is fastened a pair of annular flanges 21*a* and 21*b*, respectively lower and upper, in which are formed respective through holes aligned in pairs in correspondence with the shafts 12. To the flanges 21*a* and 21*b* are associated guiding bushings to guide the sliding and the rotation of the shafts 12.

Below the lower flange 21*a* is defined an area 23, substantially closed to the outside environment, into which during the sterilisation phase is fed a sterilising agent (for instance a solution containing about 2% of peracetic acid, known also as "Oxonia", at a temperature of about 40° C.), and during the production phases sterile air is fed, in order to create a controlled atmosphere to maintain under sterile conditions the environment that comes in contact with the product contained in the containers 9 during the closing of the caps 19.

The part of the equipment 1 above the flange 21*a* is not immersed in the controlled atmosphere present in the area 23 to that, because of the alternating motion of the shafts 12, impurities present in the part of the equipment above the flange 21*a* can be dragged to the sterile area 23, which could contaminate it.

To prevent this from occurring, between shelves, hence in proximity to the area 23, preferably stationary heating means 25 are associated to each shaft 12, which heating means are destined to perform a heating action localised only to the part 12*a* of the shaft that is proximate to the related screwing head 10, i.e. to its part that penetrates in alternating fashion into the area 23, to maintain it at such a temperature as to guarantee its sterility.

These heating means 25 advantageously comprise for each shaft 12 an assembly that comprises a metallic sleeve 26 surrounding a portion of the part 12*a* and fastened, for instance, to the annular flange 21*a*. To the sleeve 26 is externally associated a resistive organ 27 provided with at least an electrical resistance element. Preferably, each resistive organ 27 is armband-shaped and comprises to semicircular arched portions articulated about a shared axis parallel to the general axis of the sleeve 26, each of the two arched portions being provided with a resistance element. The two arched portions can assume a mutually approached configuration in which they are in contact with the outer surface of the sleeve 26, and a mutually distanced configuration in which it is possible to remove the armband-shaped resistive organ 27 from the sleeve 26 transversely to the axis of the shaft 12.

For instance, each resistance element of a resistive organ 27 is constructed in such a way as to be able to output a thermal power of about 140 W, once connected by means of conductors 27*a* to a source of electrical energy, so that the thermal power supplied to each part 12*a* of a shaft 12 is about 280 W, sufficient to maintain this part at a temperature ranging between about 100° C. and 140° C., during normal operations.

The head supplied by each resistive organ 27, which is transferred to the part 12*a* through the sleeve 26, remains prevalently localised in correspondence only with the part 12*a* of the involved shaft 12, so that the remaining part of the shaft 12 is not substantially heated, or is heated only to a negligible extent, by the heat supplied by the resistive organ 27. The sleeve 26 preferably extends over a length that is substantially equal, or slightly greater, than the stroke of the shaft 12. Its function is to serve as a thermal diffusion element for the heat supplied by the resistive organ 27 in order to distribute it in nearly uniform fashion over the portion 12*a* of the shaft 12.

At the axial ends of each shaft 26, in proximity to the shelves 21 a and 21*b*, are associated respective thermal insulation heads 28, made for instance of a thermoplastic material able to withstand high temperature, such as a material known under the commercial name "TekaPeek".

Between the shaft 12 and the related sleeve 26 is obtained a tubular space in which an air gap is present. In this gap projects a sensitive end of a thermostatic thermocouple or sensor probe 29 mounted on the sleeve 26 in such a way as to traverse it.

The information about the heat measured by each probe 29 is transferred by means of conductors 29*a* towards an electronic control unit 36 (shown in FIG. 4) to verify whether the generated heat exceeds a threshold value, in which case the electronic control unit 36 commands the opening of a switching device, described farther on, interposed between the resistive organs 27 and a source of electrical energy supply, until the temperature drops below the threshold, in order to perform a feed-back regulating action on the temperature.

FIG. 4 shows, by way of example, a block diagram schematically illustrating the main elements of a system for controlling the temperature of the shafts 12 for carrousel capping equipment 1 provided with ten screwing heads 10.

At the sides of each screwing head 10 are present, on one side, a resistive organ 27 and, on the other side, a thermostatic sensor 29.

The information about the temperature measured by each sensor 29 is collected by means of one or more input modules for thermocouples 30, each serving as a collector, and sent to an adapter module 32, for instance with ten inputs and ten digital outputs, of the bus type. Through a rotating distribution module 34, typically of the eight pole mercury type, the signals are then transferred from the rotating part of the equipment 1 to the electronic control unit 36, of the PLC type, associated to the stationary part of the equipment. The input signals to the electronic control unit 36 are processed, for instance by comparing the temperature values measured by the sensors 29 to a pre-set threshold value, to generate digital control signals which in turn are transmitted to the adapter module 32, also through the rotating distribution module 34, and therefrom to modules 40 containing the switching devices. Said switching devices include static relays driven by means of direct current power supply, for instance at 24V, by a source 38 of direct current electrical energy, which also powers the adapter module 32 in a known manner.

The static relays of the modules 40 are operatively interposed between the resistive organs 27 and a source of electrical energy 44, typically of the alternating type at 220V, the source 44 being connected to the modules 40 by means of a rotating distribution module 42 of the type with brushes and with rings.

The modules 40 that contain the static relays can be four in the present case of equipment with ten screwing heads 10, to each whereof are connected two or three resistive organs 27. Each of the static relays of the modules 40, thanks to the fact that it has a settable minimum current threshold, is also able to generate an alarm signal in case of malfunction of a resistive organ 27.

What is claimed is:

1. Automatic capping equipment provided with sterilisation means, having at least a rotary screwing head (10) able to screw a cap (19) onto the mouth of a container (9) fed below said screwing head (10), in which the screwing head (10) operates in a sterile area (23) of the equipment (1) and is supported by a related sliding support shaft (12) destined to be animated with an alternating motion, heating means being associated to said support shaft (12), wherein the heating means (25) are associated to said support shaft (12) in correspondence with an operating part (12*a*) thereof that is moved into and out of to said sterile area (23) for performing a heating action that is localised to said operating part (12*a*) of the shaft (12) to maintain it at such a temperature as to guarantee its sterile condition and in such a way that the remaining part of each shaft (12) is not substantially heated by the heating means (25).

2. Equipment as claimed in claim 1, wherein the equipment is of the carrousel type and has a plurality of screwing heads (10) so mounted as to be able to revolve about a main axis (3) of the equipment (1) distanced from the axes of the support shafts (12) of the screwing heads (10), each of which is able to screw a cap (19) onto the mouth of a respective container (9) set in rotation about said main axis (3) synchronously with a screwing head (10).

3. Equipment as claimed in claim 1 or 2, wherein the heating means has for each shaft (12) a heating assembly (25), stationary with respect to the related shaft (12).

4. Equipment as claimed in claim 3, wherein said heating assemblies (25) include at least a resistive organ (27) able to be connected with a source of electrical energy (44).

5. Equipment as claimed in claim 4, wherein to each shaft (12) are associated temperature sensor means (29) in correspondence with or in proximity to its operating part (12*a*).

6. Equipment as claimed in claim 5, wherein the heating means (25) and the temperature sensor means (29) are associated to control means (36, 40) able to perform a feedback regulating action on the supply of electrical energy to the resistive organs (27) by said source (44), according to the temperature measured by the sensor means (29).

7. Equipment as claimed in claim 6, wherein said control means has a control unit (36) whereto are connected the sensor means (29) and a switching device (40) interposed between each resistive organ (27) and said source of electrical energy (44), each switching device (40) being susceptible to being commanded by said control unit (36).

8. Equipment as claimed in any of the claims from 3, wherein each heating assembly (25) includes a metal sleeve (26) which surrounds a related shaft (12), serving as a thermal diffusion element.

9. Equipment as claimed in claim 8, wherein the temperature sensor means has for each support shaft (12) a thermostatic probe (29) which traverses said sleeve (26) and is provided with a sensitive end which projects in an air gap interposed between each sleeve (26) and the related support shaft (12).

10. Equipment as claimed in claim 9, wherein each resistive organ (27) is removable in a direction substantially transverse to the axis of the related shaft (12) and has two arched portions articulated about an axis that is parallel to the general axis of the related sleeve (26), each of said portions being provided with a respective resistance element.

* * * * *